US007182983B2

(12) United States Patent
Lenger

(10) Patent No.: US 7,182,983 B2
(45) Date of Patent: Feb. 27, 2007

(54) ARTIFICIAL CHRISTMAS TREE

(76) Inventor: Charlene Lenger, 3220 Whitfield Ave., Sarasota, FL (US) 34243

( * ) Notice: Subject to any disclaimer, the term of this patent is extended or adjusted under 35 U.S.C. 154(b) by 181 days.

(21) Appl. No.: 10/925,817

(22) Filed: Aug. 25, 2004

(65) Prior Publication Data

US 2006/0045993 A1 Mar. 2, 2006

(51) Int. Cl.
*A47G 33/06* (2006.01)
*A41G 1/00* (2006.01)

(52) U.S. Cl. ..... 428/20; 428/18; 428/27

(58) Field of Classification Search ..... 428/18, 428/19, 20; 211/196, 205; 362/123; D11/118; 493/956

See application file for complete search history.

(56) References Cited

U.S. PATENT DOCUMENTS 3,210,232 A * 10/1965 Wielland ..... 428/7
5,338,585 A * 8/1994 Fraus et al. ..... 428/18
5,639,521 A * 6/1997 Fraus et al. ..... 428/8

* cited by examiner

*Primary Examiner*—Jennifer C. McNeil
*Assistant Examiner*—Aaron Austin
(74) *Attorney, Agent, or Firm*—Arthur W. Fisher, III

(57) ABSTRACT

An artificial Christmas tree comprising a plurality of tiers configured to facilitate assembly for use and disassembly for storage including a lower substantially frustum conical tier to support an open mesh substructure to receive and support a plurality of simulated sprays or Christmas tree branches and Christmas decorations, an intermediate substantially frustum conical tier to support an open mesh substructure to receive and support a plurality of simulated sprays or Christmas tree branches and Christmas decorations and an upper substantially conical tier to support an open mesh substructure to receive and support a plurality of simulated sprays or Christmas tree branches and Christmas decorations.

21 Claims, 7 Drawing Sheets

ARTIFICIAL CHRISTMAS TREE

BACKGROUND OF THE INVENTION

1. Field of the Invention

An artificial Christmas tree comprising a plurality of tiers configured to facilitate assembly for use and disassembly for storage.

2. Description of the Prior Art

Artificial trees have been commercially available for those who prefer a tree that may be used year after year during the Christmas season in lieu of the annual purchase of a natural tree. Some of these artificial trees resemble the natural Scotch pine capable of being stored not in use. Some artificial trees may include an upright or multitude wooden or plastic trunk member secured to a base element and branch members to simulate a natural tree. Generally such trees are easily erected by positioning the inner end of each such branch member in one of a plurality of downwardly slanting, radially and vertically spaced holes drilled in the upright trunk member, and may likewise be relatively quickly disassembled for storage by removing the inner end of each branch members from the hole in the trunk member in which it has been positioned. Such artificial trees, however, as with natural trees, require hours of effort to decorate in the traditional Christmas season style.

Numerous examples of such trees are found in the prior art discussed hereinafter.

U.S. Pat. No. 1,490,409 discloses a toy device comprising a vertically arranged standard, a plurality of horizontally arranged supports removably mounted substantially centrally of the supports on the standard in spaced apart relation, one above another. The supports are of different dimensions in directions radial of the standard and being adapted to be arranged thereon with their respective peripheries defining a structure relatively small at the top and relatively large at the bottom and readily removable frusto-conical filler pieces substantially occupying the space between adjacent supports.

U.S. Pat. No. 3,219,512 relates to an artificial tree comprising an upright member, a plurality of separate sections individually supported on the upright members. Each section includes a shade like wall of truncated shape with the sections progressively increasing in the diameter from the top section to the bottom section. The sections each have a diameter at the bottom equal to or greater than the diameter at the top of the adjacent lower section so that when the sections are secured to the supporting member the sections are arranged so that they either overlap the lower adjacent section or form a continuous inclined wall therewith.

U.S. Pat. No. 3,692,617 discloses a modular tree comprising a frame assembly of wire elements secured together to define a tapering frame. Rings of different diameters fit over the frame, each ring having a plurality of branch ends to respective points along the ring. The branches face outwardly and define rows of simulated tree branches.

U.S. Pat. No. 5,085,901 shows an artificial tree comprising a top section, a bottom section and a centrally positioned adjustable vertical pole which is height adjustable. The top section has a top member and a plurality of rings with the lower most ring also having a plurality of spokes interconnecting the ring with an inner hub. A plurality of strings depends downwardly from the top member and secure each of the other rings in their desired parallel positions. The bottom section also has a plurality of rings with the upper most and lower most rings having spokes and inner hubs. The rings of the bottom section are also connected together by string. The upper most ring of the bottom section sets atop the height adjustment means. In addition to the pole preferably having two sections telescopically oriented with respect to each other, the tree also is formed with strands of garland and preferably ornaments secured thereto.

U.S. Pat. No. 5,299,381 discloses a container including a plurality of support legs, where each support legs including a plurality of wheel members adjustably mounted to provide for ease of leveling of the container structure and Christmas tree fastening rod members.

U.S. Pat. No. 5,486,386 teaches a collapsible artificial tree comprising open mesh material in a conical shape. A plurality of axially spaced outer hoops defines the substantially conical shape of the tree with smaller inner hoops axially located between the outer hoops providing the artificial tree with the characteristic sawtooth profile of a coniferous tree.

U.S. Pat. No. 6,270,864 discloses an artificial Christmas tree comprising a stand base, a stand pillar, at least two truncated-cone elements conically graduated in terms of size, an a conical element for the top of the tree. The elements are detachably fastened to each other so as to form a stylized tree which can be easily disassembled for storage.

Additional examples of the prior art are found in; U.S. Pat. Nos. 1,654,427; U.S. 1,662,091; U.S. 2,186,327; U.S. 2,278,898; U.S. 2,500,215; U.S. 2,524,450; U.S. 2,586,791; U.S. 3,210,232; U.S. 3,244,870; U.S. 3,544,783; U.S. 3,819,459:U.S. 3,839,131; U.S. 4,734,301; U.S. 4,878,157; U.S. 4,937,107; U.S. 5,338,585; U.S. 5,388,799; U.S. 5,639,521; U.S. 6,048,590; U.S. 6,500,214 and 2002/0097573 (application).

SUMMARY OF THE INVENTION

The present invention relates to an artificial Christmas tree comprising a plurality of tiers including a lower tier, an intermediate tier and an upper tier. The lower tier comprises a lower frame including an upper and lower base member held in spaced relationship relative to each other by a plurality of elongated lower frame members supporting an open mesh substructure configured to receive and support a plurality of simulated sprays or Christmas tree branches and a plurality of Christmas decorations. The intermediate tier comprises an intermediate frame including an upper and lower base member held in spaced relationship relative to each other by a plurality of elongated intermediate frame members supporting an open mesh substructure configured to receive and support a plurality of simulated of Christmas tree branches and a plurality of Christmas decorations. The upper tier comprises an upper frame including a lower base member and a plurality of elongated upper frame members supporting an open mesh substructure configured to receive and support a plurality of simulated sprays or Christmas tree branches and a plurality of Christmas decorations.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
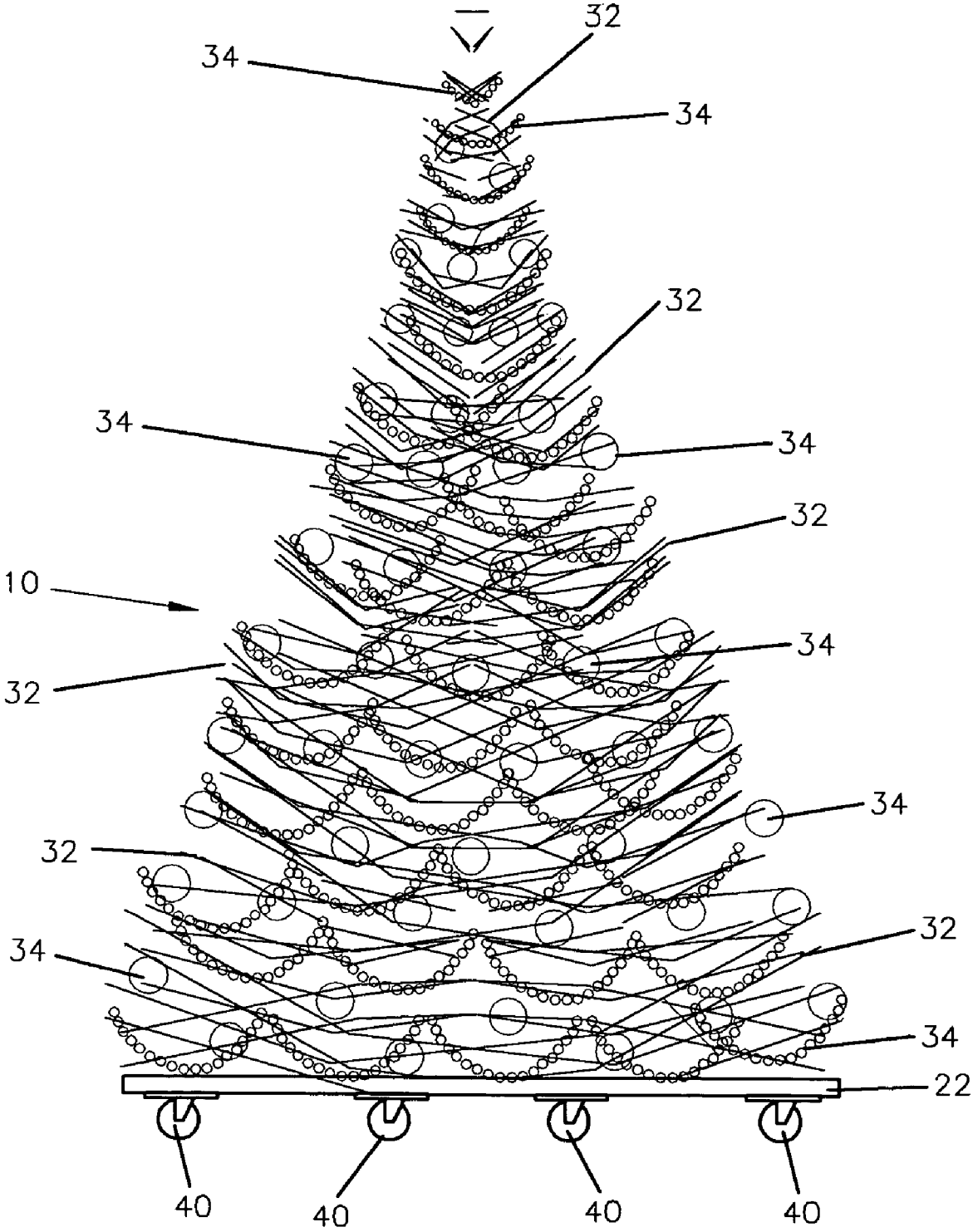
FIG. 1 is a front view of the artificial Christmas tree of the present invention.
Figure 2:
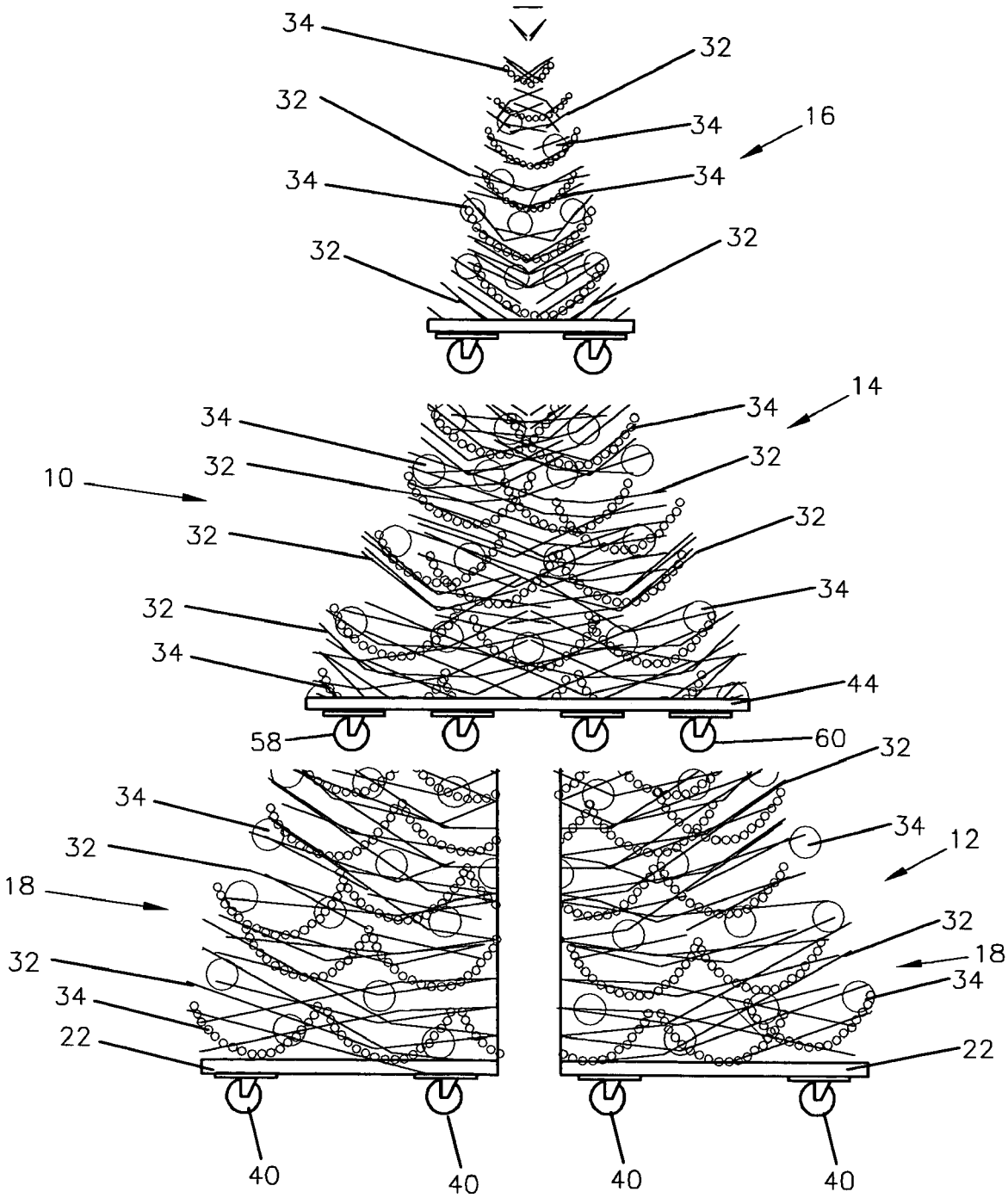
FIG. 2 is an exploded front view of the artificial Christmas tree of the present invention.
Figure 3:
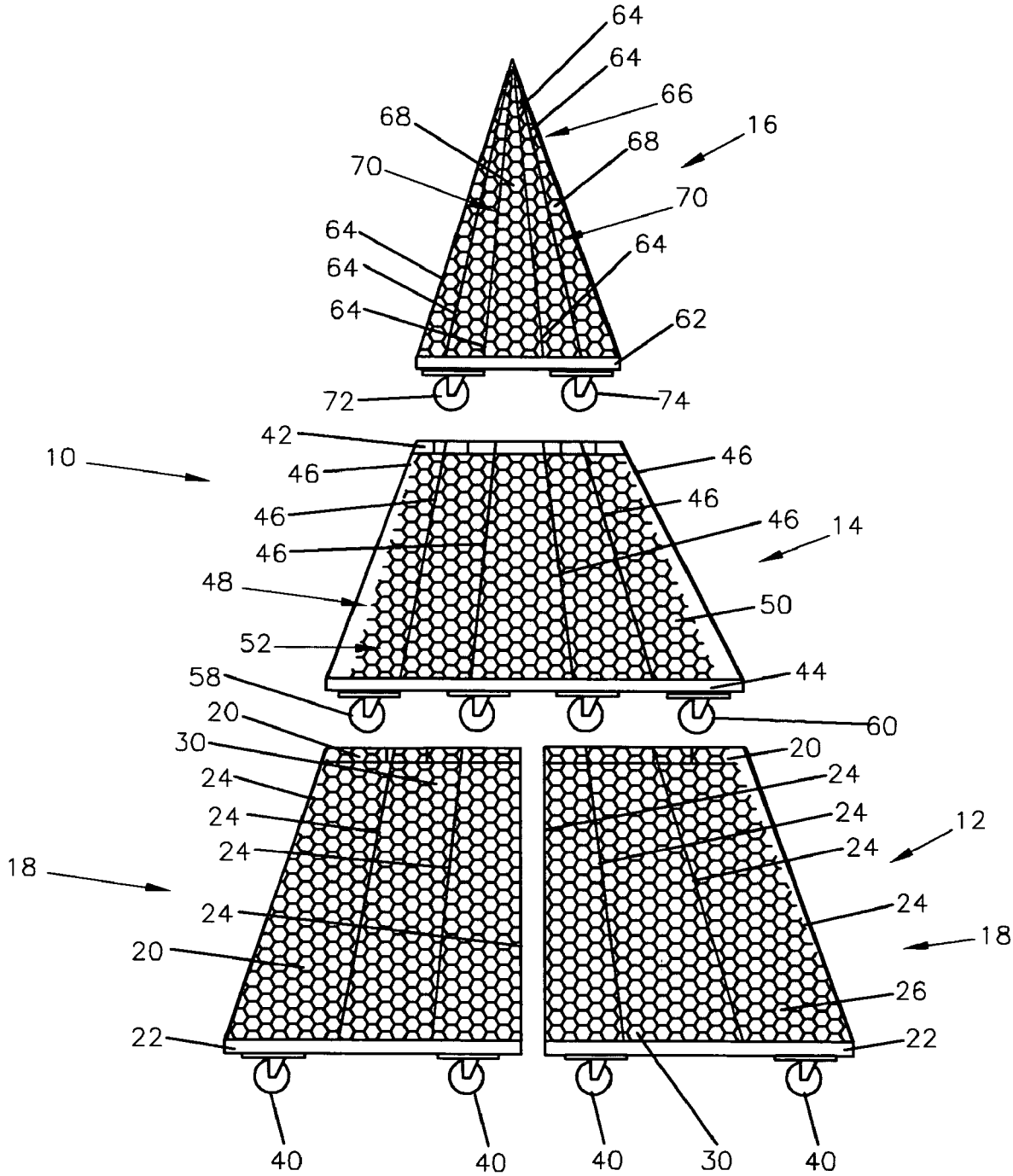
FIG. 3 is an exploded front view of the plurality of tiers of the present invention.

As shown in FIGS. 1 and 2, the present invention relates to an artificial Christmas tree generally indicated as 10. As best shown in FIGS. 2 and 3, the artificial Christmas tree 10 comprises a plurality of tiers including a lower frustum conical tier generally indicated as 12, an intermediate frustum conical tier generally indicated as 14 and an upper conical tier generally indicated as 16.

As best shown in FIGS. 3, 4, 4A and 4B, the lower frustum conical tier 12 comprises a pair of lower tier sections each generally indicated as 18. Each lower tier section 18 comprises a lower frame including an upper and lower substantially flat, rigid base member indicated as 20 and 22 respectively held in substantially parallel spaced relationship relative to each other by a plurality of diagonally disposed elongated rigid lower frame members each indicated as 24 supporting an open mesh substructure generally indicated as 26. The open mesh substructure 26 comprises a malleable wire support or netting including elongated interwoven elements each indicated as 28 cooperatively forming a plurality of openings each indicated as 30.

As shown in FIGS. 1 and 2, the open mesh substructure 26 is configured to receive and support a plurality of simulated sprays or Christmas tree branches each indicated as 32 and a plurality of Christmas decorations each indicated as 34.

Figure 4A:
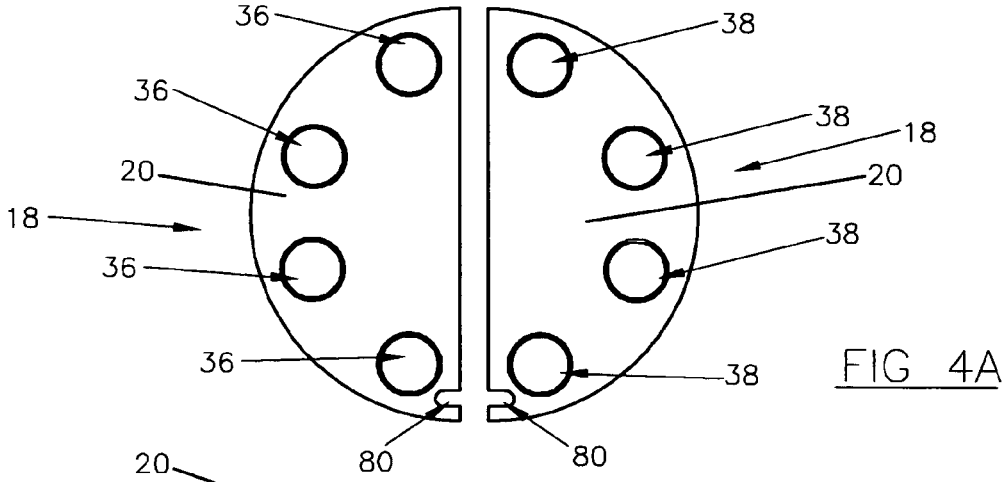
FIG. 4A is a top view of the lower frustum conical tier of the present invention.
Figure 4:
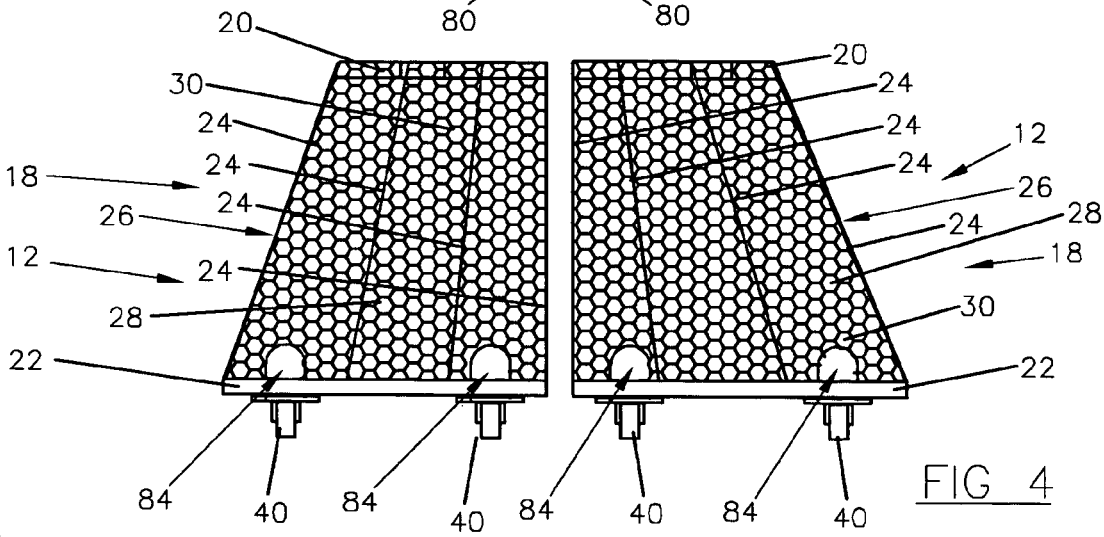
FIG. 4 is a front view of the lower frustum conical tier of the present invention.
Figure 4B:
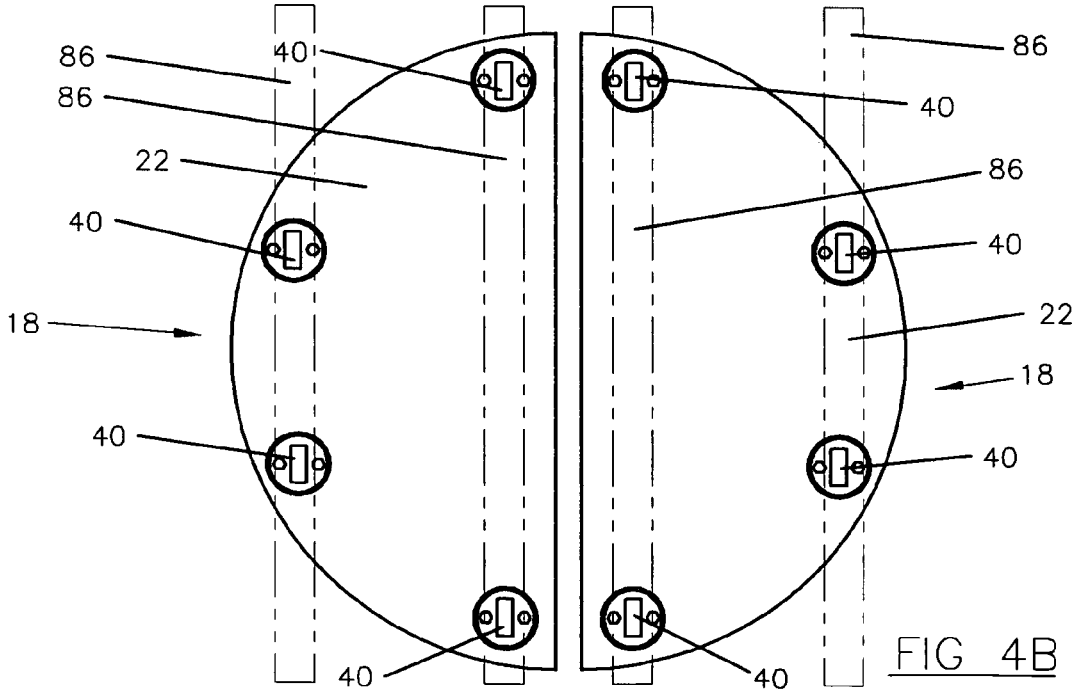
FIG. 4B is a bottom view of the lower frustum conical tier of the present invention.

As shown in FIG. 4A, the upper substantially flat, rigid base member 20 includes a first pair of apertures each indicated as 36 and a second pair of apertures each indicated as 38 formed therethrough. As shown in FIGS. 1 through 4 and 4B, a plurality of casters or wheels each indicated as 40 are coupled to the lower substantially flat, rigid base member 22.

As best shown in FIGS. 3, 5, 5A and 5B, the intermediate frustum conical tier 14 comprises an intermediate frame including an upper and lower substantially flat, rigid base member indicated as 42 and 44 respectively held in substantially parallel spaced relationship relative to each other by a plurality of diagonally disposed elongated rigid intermediate frame members each indicated as 46 supporting an open mesh substructure generally indicated as 48. The open mesh substructure 48 comprises a malleable wire support or netting including elongated interwoven elements each indicated as 50 cooperatively forming a plurality of open openings each indicated as 52.

As shown in FIGS. 1 and 2, the open mesh substructure 48 is configured to receive and support a plurality of simulated sprays or Christmas tree branches 32 and a plurality of Christmas decorations 34.

Figure 5A:
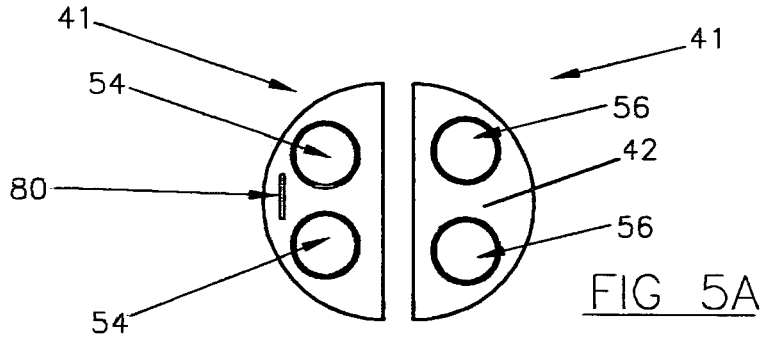
FIG. 5A is a top view of the intermediate frustum conical tier of the present invention.
Figure 5:
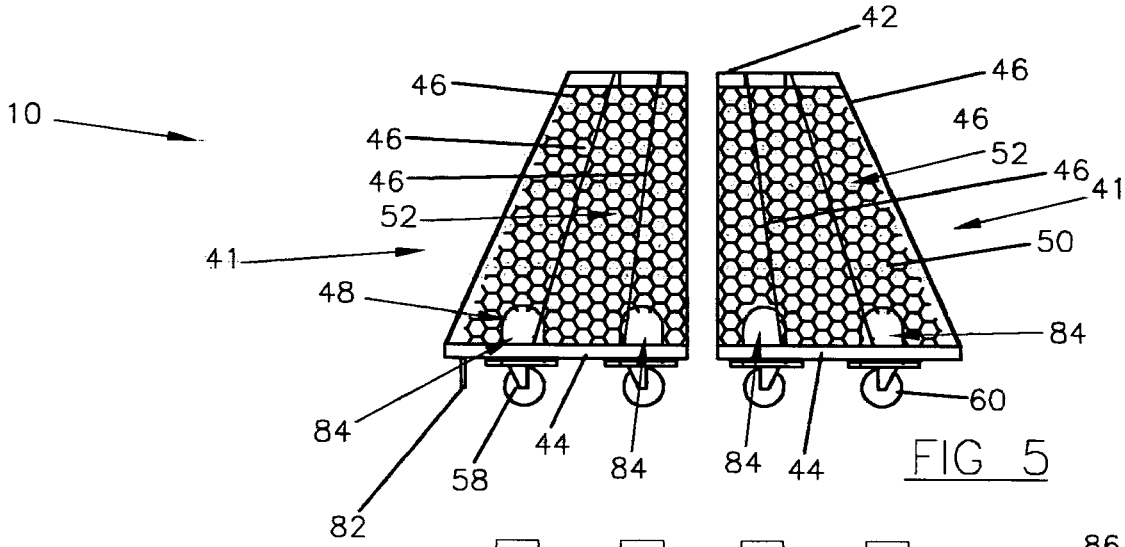
FIG. 5 is a side view of the intermediate frustum conical tier of the present invention.

As shown in FIG. 5A, the upper substantially flat, rigid base member 42 includes a first pair of apertures each indicated as 54 and a second pair of apertures each indicated as 56 formed therethrough. As shown in FIGS. 2, 3, 5 and 5B, a first plurality of casters or wheels each indicated as 58 and a second plurality of casters or wheels each indicated as 60 are coupled to the lower substantially flat, rigid base member 44.

Figure 6:
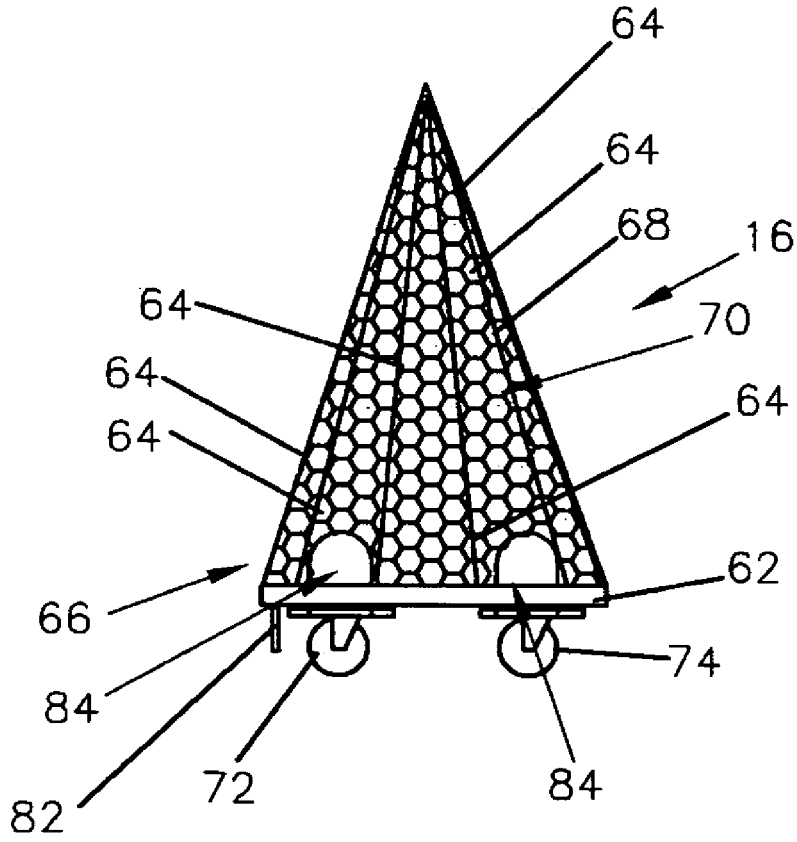
FIG. 6 is a front view of the top conical tier of the present invention.
Figure 6A:
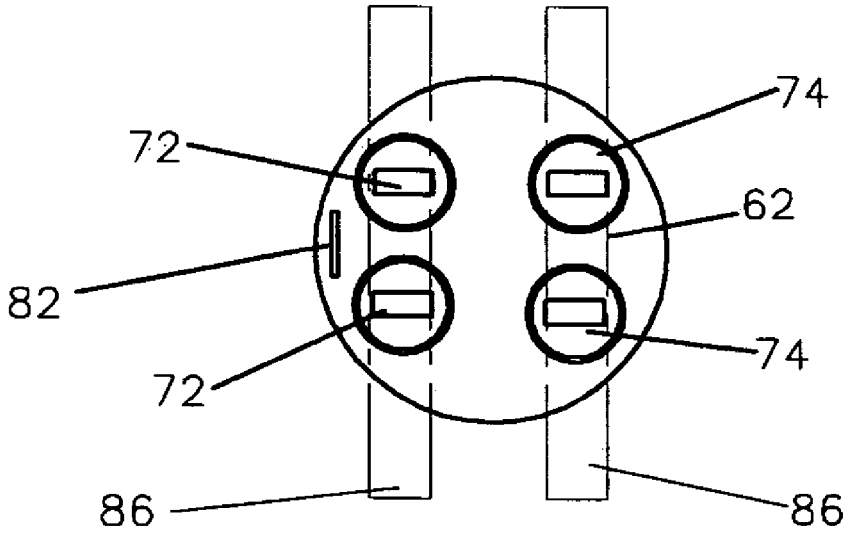
FIG. 6A is a bottom view of the top conical tier of the present invention.

As best shown in FIGS. 3, 6 and 6A, the upper frustum conical tier 16 comprises an upper frame including a lower substantially flat, rigid base member 62 and a plurality of diagonally disposed elongated rigid upper frame members each indicated as 64 supporting an open mesh substructure generally indicated as 66. The open mesh substructure 66 comprises a malleable wire support or netting including elongated interwoven elements each indicated as 68 cooperatively forming a plurality of openings each indicated as 70.

As shown in FIGS. 1 and 2, the open mesh substructure 48 is configured to receive and support a plurality of simulated sprays or Christmas tree branches 32 and a plurality of Christmas decorations 34.

The casters or wheels 40, 58 and 60, and 72 and 74 support the lower frustum conical tier 12, the intermediate frustum conical tier 14 and the upper conical tier 16 on ground or firm surface when the artificial Christmas tree 10 is disassembled to move the artificial Christmas tree 10 to and from storage.

As shown in FIG. 4A, the distance between the centers of the first pair of apertures 36 formed through the upper substantially flat, rigid base member 20 of the lower frustum conical tier 12 is less than the distance between the centers of the second pair of apertures 38 formed through the upper substantially flat, rigid base member 20 of the lower frustum conical tier 12.

Figure 5B:
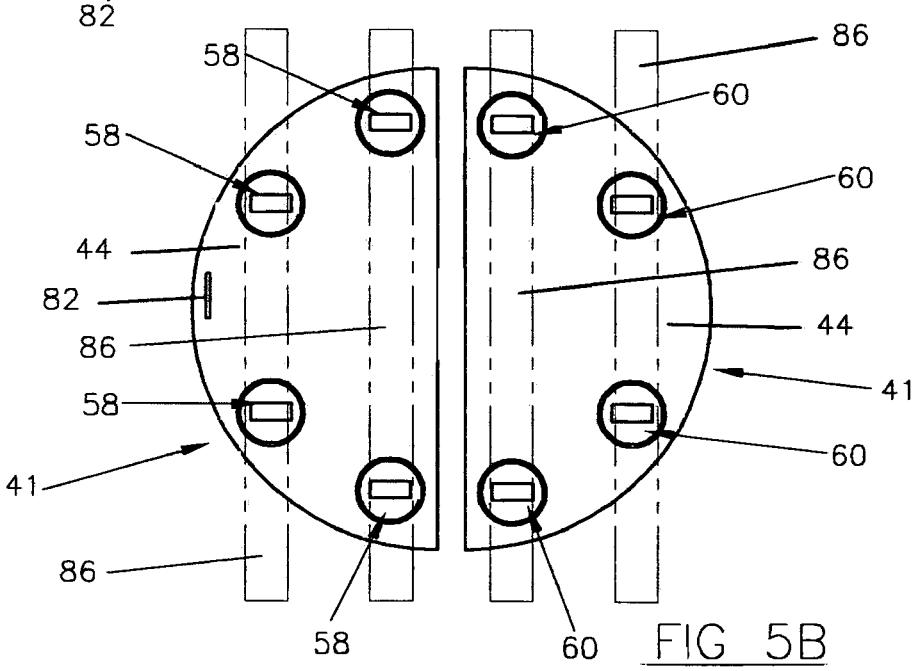
FIG. 5B is a bottom view of the intermediate frustum conical tier of the present invention.

As shown in FIG. 5B, the distance between the centers of the first plurality of casters or wheels 58 coupled to the lower substantially flat, rigid base member 44 of the intermediate frustum conical tier 14 is less than the distance between the centers of the second plurality of casters or wheels 60 coupled to the lower substantially flat, rigid base member 44 of the intermediate frustum conical tier 14.

The distance between the centers of the first pair of casters or wheels 58 is substantially equal to the distance between the centers of the first pair of apertures 36 and the distance between the centers of the second pair of casters or wheels 60 is substantially equal to the distance between the center of the second pair of aperture 38 such that the intermediate frustum conical tier 14 is indexed or aligned relative to the lower frustum conical tier 12 by positioning the first pair of apertures 36 in vertical alignment with the first pair of casters or wheels 58 and the second pair of apertures 38 in vertical alignment with the second pair of casters or wheels 60 whereby the intermediate frustum conical tier 14 is lowered onto the lower frustum conical tier 12 with the lower substantially flat, rigid base member 44 resting on the upper substantially flat, rigid base member 20 thereby aligning the lower frustum conical tier 12 and the intermediate frustum conical tier 14.

As shown in FIG. 5A, the distance between the centers of the first pair of apertures 54 formed through the upper substantially flat, rigid base member 42 of the intermediate frustum conical tier 14 is less than the distance between the centers of the second pair of apertures 56 formed through the upper substantially flat, rigid base member 42 of the intermediate frustum conical tier 14.

As shown in FIG. 6A, the distance between the centers of the first plurality of casters or wheels 72 coupled to the lower substantially flat, rigid base member 62 of the upper conical tier 16 is less than the distance between the centers of the second plurality of casters or wheels 74 coupled to the lower substantially flat, rigid base member 62 of the upper conical tier 16.

The distance between the centers of the first pair of casters or wheels 72 is substantially equal to the distance between the centers of the first pair of apertures 54 and the distance between the centers of the second pair of casters or wheels 74 is substantially equal to the distance between the center of the second pair of aperture 56 such that the intermediate frustum conical tier 14 is indexed or aligned relative to 56 such that the intermediate frustum conical tier 14 is indexed or aligned relative to the upper conical tier 16 by positioning the first pair of apertures 54 in vertical alignment with the first pair of casters or wheels 72 and the second pair of apertures 56 in vertical alignment with the second pair of casters or wheels 74 whereby the upper conical tier 16 is lowered onto the intermediate frustum conical tier 14 with the lower substantially flat, rigid base member 62 resting on the upper substantially flat, rigid base member 42 thereby aligning the intermediate frustum conical tier 14 and the upper conical tier 16.

The artificial Christmas tree 10 further comprises an alignment structure to maintain the lower frustum conical tier 12, the intermediate frustum conical tier 14 and upper conical tier 16 in operative alignment relative to each other when assembled. In particular, the alignment structure comprises an alignment aperture or slot 80 formed in the upper substantially flat, rigid base member 20 of the lower frustum conical tier 12 and the upper substantially flat, rigid base member 42 of the intermediate frustum conical tier 14 to receive a corresponding alignment member 82 extending downward from the lower substantially flat, rigid base member 44 of the intermediate frustum conical tier 14 and the lower substantially flat, rigid base member 62 of the upper conical tier respectively. Of course, the positions of alignment aperture or slots 80 and the alignment member 82 can be reversed.

Figure 7:
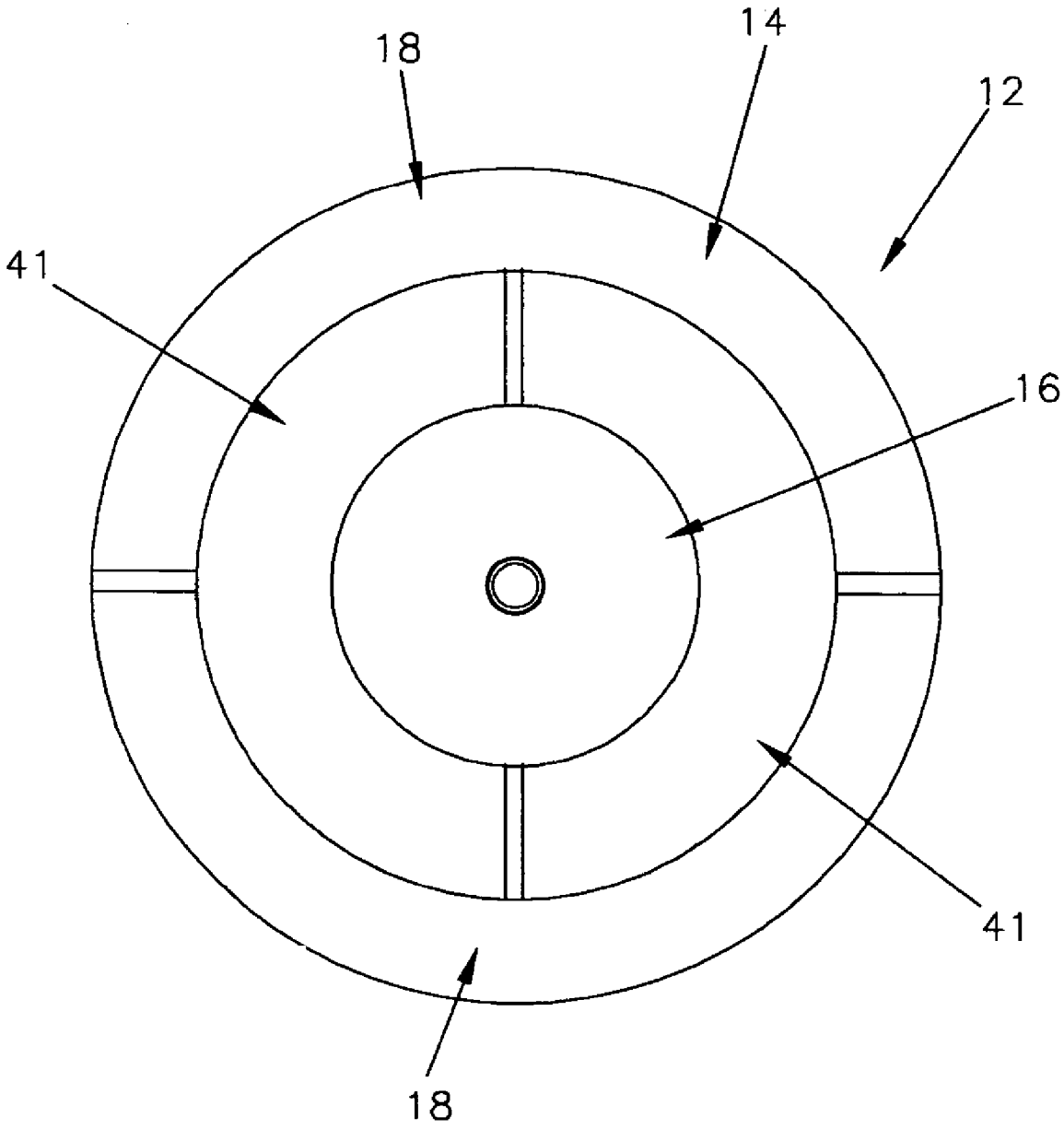
FIG. 7 is a top diagram view of the plurality of tiers of the present invention.

In addition, the artificial Christmas tree 10 can further include a lifting device comprising at least one pair of lift members such as a loop or arcuate element including an opening each indicated as 84 extending upwardly from the lower substantially flat, rigid base member 22 of the lower frustum conical tier 12, the lower substantially flat, rigid base member 44 of the intermediate frustum conical tier 14 and the lower substantially flat, rigid base member 62 of the upper conical tier 16 to receive a corresponding elongated lift member 86 therethrough extending outwardly from opposite sides of the lower frustum conical tier 12, intermediate frustum conical tier 14 and upper conical tier 16 to aid in lifting each tier 12, 14 and 16. As shown in FIG. 7, the pair of lower tier sections 18 of the lower frustum conical tier 12 and the pair of intermediate tier sections 41 of the intermediate frustum conical tier are disposed at right angles relative to each other.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An artificial Christmas tree comprising a plurality of tiers configured to facilitate assembly for use and disassembly for storage including a lower frustum conical tier comprising a lower frame including upper and lower substantially flat, rigid base members held in substantially parallel spaced relationship relative to each other by a plurality of elongated rigid lower frame members supporting a lower tier open mesh substructure to receive and support a plurality of simulated sprays or Christmas tree branches and Christmas decorations, an intermediate substantially frustum conical tier comprising an intermediate frame including upper and lower substantially flat, rigid base members held in substantially parallel spaced relationship relative to each other by a plurality of elongated rigid intermediate frame members supporting an intermediate tier open mesh substructure to receive and support a plurality of simulated sprays or Christmas tree branches and Christmas decorations and an upper substantially conical tier comprising an upper frame including a lower substantially flat, rigid base member and a plurality of elongated rigid upper frame members supporting an upper tier open mesh substructure to receive and support a plurality of simulated sprays or Christmas tree branches and Christmas decorations.

2. The artificial Christmas tree of claim 1 wherein said open mesh substructure comprises malleable wire netting including elongated interwoven elements cooperatively forming a plurality of openings.

3. The artificial Christmas tree of claim 1 further including a lifting device comprising at least one pair of lift members each of said lower substantially flat, rigid base member of said lower frustum conical tier, said lower substantially flat, rigid base member of said intermediate frustum conical tier and the lower substantially flat, rigid base member of said upper conical tier to receive a corresponding elongated lift member extending therethrough outwardly from opposite sides of said lower frustum conical tier, said intermediate frustum conical tier and said upper conical tier to aid in lifting each said tier.

4. The artificial Christmas tree of claim 1 further including a plurality of casters coupled to said lower substantially flat, rigid base member of said lower frustum conical tier, a plurality of casters coupled to said lower substantially flat, rigid base member of said intermediate frustum conical tier and a plurality of casters coupled to said lower substantially flat, rigid base member of said upper substantially conical tier to support said lower frustum conical tier, said intermediate frustum conical tier and said upper substantially conical tier when the artificial Christmas tree is disassembled to move said artificial Christmas tree to and from storage.

5. The artificial Christmas tree of claim 4 wherein said plurality of casters of said intermediate frustum conical tier comprises a first and second pair of casters coupled to said lower substantially flat, rigid base member of said intermediate frustum conical tier and said plurality of casters of said upper substantially comprises a first and second pair of casters coupled to said lower substantially flat, rigid base member of said upper substantially conical tier and wherein said upper substantially flat, rigid base member of said lower frustum conical tier includes a first and second pair of apertures formed therethrough and said upper substantially flat, rigid base member of said intermediate frustum conical tier includes a first and second pair of apertures formed therethrough wherein the distance between the centers of said first pair of apertures formed through said upper substantially flat, rigid base member of said intermediate frustum conical tier is less than the distance between the centers of said second pair of apertures formed through said upper substantially flat, rigid base member of said intermediate frustum conical tier and the distance between the centers of said first pair of casters coupled to said lower substantially flat, rigid base member of the upper conical tier is less than the distance between the centers of said second pair of casters coupled to the lower substantially flat, rigid base member of the upper conical tier; the distance between the centers of said first pair of casters is substantially equal to the distance between the centers of the first pair of apertures and the distance between said centers of the second pair of casters is substantially equal to the distance between the center of the second pair of apertures such that the intermediate frustum conical tier is indexed or aligned relative to said upper conical tier by positioning said first pair of apertures in vertical alignment with said first pair of casters and said second pair of apertures in vertical alignment with said second pair of casters whereby said intermediate frustum conical tier is lowered onto said upper conical tier thereby aligning the intermediate frustum conical tier and the upper conical tier; and wherein the distance between the centers of said first pair of apertures formed through said upper substantially flat, rigid base member of said lower frustum conical tier is less than the distance between the centers of said second pair of apertures formed through said upper substantially flat, rigid base member of said lower frustum conical tier and the distance between the centers of said first plurality of casters coupled to said lower substantially flat, rigid base member of said intermediate frustum conical tier is less than the distance between the centers of said second plurality of casters coupled to said lower substantially flat, rigid base member of said intermediate frustum conical tier; the distance between the centers of said first pair of casters is substantially equal to the distance between the centers of said first pair of apertures and the distance between the centers of said second pair of casters is substantially equal to the distance between the center of said second pair of apertures such that said intermediate frustum conical tier is indexed or aligned relative to said lower frustum conical tier by positioning said first pair of apertures in vertical alignment with said first pair of casters and said second pair of apertures in vertical alignment with said second pair of casters whereby said intermediate frustum conical tier is lowered onto said lower frustum conical tier aligning said lower frustum conical tier and said intermediate frustum conical tier.

6. The artificial Christmas tree of claim 1 wherein said lower frustum conical tier comprises a pair of lower tier sections; each said lower tier section comprises a lower frame including upper and lower substantially flat, rigid base sections held in substantially parallel spaced relationship relative to each other by a plurality of diagonally disposed elongated rigid lower frame members supporting a corresponding lower tier section open mesh substructure.

7. The artificial Christmas tree of claim 6 wherein each said corresponding lower tier section open mesh substructure comprises a malleable wire netting including elongated interwoven elements cooperatively forming a plurality of openings.

8. The artificial Christmas tree of claim 1 wherein each said lower tier, said intermediate tier, and said upper tier open mesh substructure comprises a malleable wire netting including elongated interwoven elements cooperatively forming a plurality of openings.

9. The artificial Christmas tree of claim 8 wherein said lower frustum conical tier comprises a pair of lower tier sections; each said lower tier section comprises a lower frame including upper and lower substantially flat, rigid base sections held in substantially parallel spaced relationship relative to each other by a plurality of diagonally disposed elongated rigid lower frame members supporting a corresponding lower tier section open mesh substructure.

10. The artificial Christmas tree of claim 1 further comprising an alignment structure to maintain said lower frustum conical tier, said intermediate frustum conical tier and said upper conical tier in operative alignment relative to each other when assembled.

11. The artificial Christmas tree of claim 10 wherein said alignment structure comprises an alignment each of said upper substantially flat, rigid base member of said lower frustum conical tier and said upper substantially flat, rigid base member of said intermediate frustum conical tier to receive a corresponding alignment member extending downward from each of said lower substantially flat, rigid base member of said intermediate frustum conical tier and said lower substantially flat, rigid base member of said upper conical tier.

12. The artificial Christmas tree of claim 11 further including a lifting device comprising at least one pair of lift members each of said lower substantially flat, rigid base member of said lower frustum conical tier, said lower substantially flat, rigid base member of said intermediate frustum conical tier and the lower substantially flat, rigid base member of said upper conical tier to receive a corresponding elongated lift member extending therethrough outwardly from opposite sides of said lower frustum conical tier, said intermediate frustum conical tier and said upper conical tier to aid in lifting each each said frustum conical tier and said conical tier.

13. An artificial Christmas tree comprising a plurality of tiers configured to facilitate assembly for use and disassembly for storage including a lower frustum conical tier comprising a lower frame including upper and lower base members held in spaced relationship relative to each other by a plurality of elongated rigid lower frame members supporting a lower tier open mesh substructure to receive and support a plurality of simulated sprays or Christmas tree branches and Christmas decorations and an upper substantially conical tier comprising an upper frame including a lower base member and a plurality of elongated rigid upper frame members supporting an upper tier open mesh substructure to receive and support a plurality of simulated sprays or Christmas tree branches and Christmas decorations.

14. The artificial Christmas tree of claim 13 wherein said lower tier and said upper tier open mesh substructures comprise malleable wire netting including elongated interwoven elements cooperatively forming a plurality of openings.

15. The artificial Christmas tree of claim 13 further including a plurality of casters coupled to said lower substantially flat, rigid base member of said lower frustum and a plurality of casters coupled to said lower substantially flat, rigid, base member of said upper substantially conical tier to support said lower frustum conical tier and said upper substantially conical tier when said artificial Christmas tree is disassembled to move the artificial to and from storage.

16. The artificial Christmas tree of claim 15 wherein said plurality of casters comprises a first pair of casters coupled to said lower base member of said upper conical tier and a second pair of casters coupled to said lower base member of said upper conical tier and said upper base member of said lower frustum conical tier includes a first pair of apertures formed therethrough and a second pair of apertures formed therethrough and wherein the distance between the centers of said first pair of apertures is less than the distance between the centers of said second pair of apertures and the distance between the centers of said first pair of casters is less than the distance between the centers of said second pair of casters and the distance between said centers of the first pair of casters is substantially equal to the distance between the centers of the first pair of apertures and the distance between the centers of the second pair of casters is substantially equal to the distance between the centers of the second pair of apertures such that said lower frustum conical tier is indexed or aligned relative to said upper conical tier by positioning said first pair of apertures in vertical alignment with said first pair of casters and said second pair of apertures in vertical alignment with said second pair of casters whereby said upper conical tier is lowered onto said lower frustum conical tier with said lower base member of said upper conical tier resting on said upper base member of said lower frustum conical thereby aligning said lower frustum conical tier and said upper conical tier.

17. The artificial Christmas tree of claim 13 wherein said lower frustum conical tier comprises a pair of lower tier sections; each said lower tier section comprises a lower frame including upper and lower base sections held in substantially parallel spaced relationship relative to each other by a plurality of diagonally disposed elongated rigid lower frame members supporting a corresponding lower tier section open mesh substructures.

18. The artificial Christmas tree of claim 17 wherein said upper conical tier comprises an upper frame including a lower substantially flat, rigid base member and a plurality of diagonally disposed elongated rigid upper frame members supporting an upper tier open mesh substructure.

19. The artificial Christmas tree of claim 18 wherein said upper tier open mesh substructure comprises a malleable wire support or netting including elongated interwoven elements cooperatively forming a plurality of openings.

20. The artificial Christmas tree of claim 17 wherein each said corresponding lower tier section open mesh substructure comprises a malleable wire netting including elongated interwoven elements cooperatively forming a plurality of openings.

21. The artificial Christmas tree of claim 20 wherein said upper conical tier comprises an upper frame including a lower substantially flat, rigid base member and a plurality of diagonally disposed elongated rigid upper frame members supporting an upper tier open mesh substructure.

* * * * *